US010441956B2

(12) United States Patent
Furtado et al.

(10) Patent No.: US 10,441,956 B2
(45) Date of Patent: Oct. 15, 2019

(54) ANVIL ASSEMBLY FOR VSI CRUSHER

(71) Applicant: Rock Engineered Machinery Company, Inc., Livermore, CA (US)

(72) Inventors: Miguel Furtado, Ceres, CA (US); Kevin Cadwalader, Manteca, CA (US)

(73) Assignee: Rock Engineered Machinery Company, Inc., Livermore, CA (US)

( * ) Notice: Subject to any disclaimer, the term of this patent is extended or adjusted under 35 U.S.C. 154(b) by 483 days.

(21) Appl. No.: 15/239,723

(22) Filed: Aug. 17, 2016

(65) Prior Publication Data

US 2017/0050189 A1 Feb. 23, 2017

Related U.S. Application Data

(60) Provisional application No. 62/206,154, filed on Aug. 17, 2015.

(51) Int. Cl.
*B02C 19/00* (2006.01)
*B02C 13/18* (2006.01)

(52) U.S. Cl.
CPC ..... *B02C 19/0012* (2013.01); *B02C 13/185* (2013.01); *B02C 19/0043* (2013.01); *B02C 2210/02* (2013.01)

(58) Field of Classification Search
CPC ..... B02C 19/0018; B02C 19/0012; B02C 19/0043; B02C 13/185
USPC ..... 241/275, 300, 291
See application file for complete search history.

(56) References Cited

U.S. PATENT DOCUMENTS

| | | | | |
|---|---|---|---|---|
| 3,074,657 | A | 1/1963 | Bridgewater | |
| 4,347,988 | A | 9/1982 | Warren et al. | |
| 4,699,326 | A | 10/1987 | Warren | |
| 4,756,484 | A | 7/1988 | Bechler et al. | |
| 6,149,086 | A * | 11/2000 | Young | B02C 13/1828 241/275 |
| 6,179,234 | B1 * | 1/2001 | Marshall | B02C 13/1814 241/275 |
| 6,405,953 | B1 * | 6/2002 | Warren | B02C 13/1814 164/98 |
| 7,841,551 | B2 * | 11/2010 | Potter | B02C 13/1807 241/275 |
| 7,866,585 | B2 | 1/2011 | Hall et al. | |
| 2005/0001082 | A1 * | 1/2005 | Strauss | B02C 13/1807 241/275 |
| 2005/0067517 | A1 * | 3/2005 | Rose | B02O 13/1814 241/275 |

(Continued)

*Primary Examiner* — Christopher M Koehler
*Assistant Examiner* — Mohammed S. Alawadi
(74) *Attorney, Agent, or Firm* — Brian Beverly; Beeson Skinner Beverly, LLP

(57) ABSTRACT

An anvil assembly for a vertical shaft impact rock crushing machine includes a plurality of anvils and anvil holders, each anvil holder including an anchor plate and a buttress wall, the anchor plate having dual tapered shoulders and the buttress wall extending perpendicularly from one side of the anchor plate. The rear face of each anvil includes dual vertically-mirroring docking ports each having dual, inwardly-oriented, angularly inclined side channels. In a mounted configuration the shoulders of each anchor plate are detachably captured in the side channels of one of the docking ports, thereby supporting each anvil on the anvil holder and securing it to the crushing machine.

21 Claims, 7 Drawing Sheets

(56) References Cited

U.S. PATENT DOCUMENTS

| | | | | |
|---|---|---|---|---|
| 2007/0007376 | A1 | 1/2007 | Condon et al. | |
| 2008/0191077 | A1* | 8/2008 | Bentley | B02C 13/185<br>241/275 |

* cited by examiner

ANVIL ASSEMBLY FOR VSI CRUSHER

CROSS-REFERENCE TO RELATED APPLICATIONS

This application claims the benefit of U.S. Provisional Application No. 62/206,154 filed Aug. 17, 2015.

BACKGROUND

A conventional anvil-type VSI rock crusher includes a plurality of anvils secured to an anvil ring in a circular configuration. A spinning rotor mounted on a vertical shaft positioned at the center of the anvil ring ejects material directed through the top of the rotor laterally through exit ports. The material ejected from the rotor impacts the anvils at extremely high velocity and shatters into smaller particle sizes.

Although anvil-type rock crushers are highly effective, the anvils experience substantial wear given the severe conditions under which they function and must be replaced regularly. The replacement operation is time consuming and expensive for the operator because replacement parts are expensive, the crusher is out of service, and a scrap fee is incurred for discarding the worn out anvils.

A conventional anvil assembly known in the prior art is shown in FIG. 1. With additional reference to FIGS. 2A and 2B, it can be seen that the anvil 1 comprises an impact body 2 connected to a mounting stob 3 via neck 4. The anvil 1 is attached to an anvil ring 5 using a slotted anchor plate 6 welded to the anvil ring. Gaps 7 between adjacent anvils 1 are blocked off using a smaller side anvil 8 secured to the anvil ring 5 with a second anchor plate 9.

When one side $S_1$ of the anvil is fully consumed, the anvil can be pulled up, inverted, and reinstalled to expose the other side to wear. When the second side $S_2$ of the anvil is consumed, as shown in FIG. 2C, the anvil is removed and replaced with a new one. Since the mounting stob 3 and neck 4 must be discarded along with the body 2, this results in high scrap loss and disposal expense to the end user. The scrap loss increases if the side anvil 8 must also be replaced. It will also be appreciated that the conventional anvil 1 is more expensive to manufacture because of the need to incorporate material to form the stab 3 and neck 4.

DETAILED DESCRIPTION OF THE ILLUSTRATED EMBODIMENT

Figure 1:
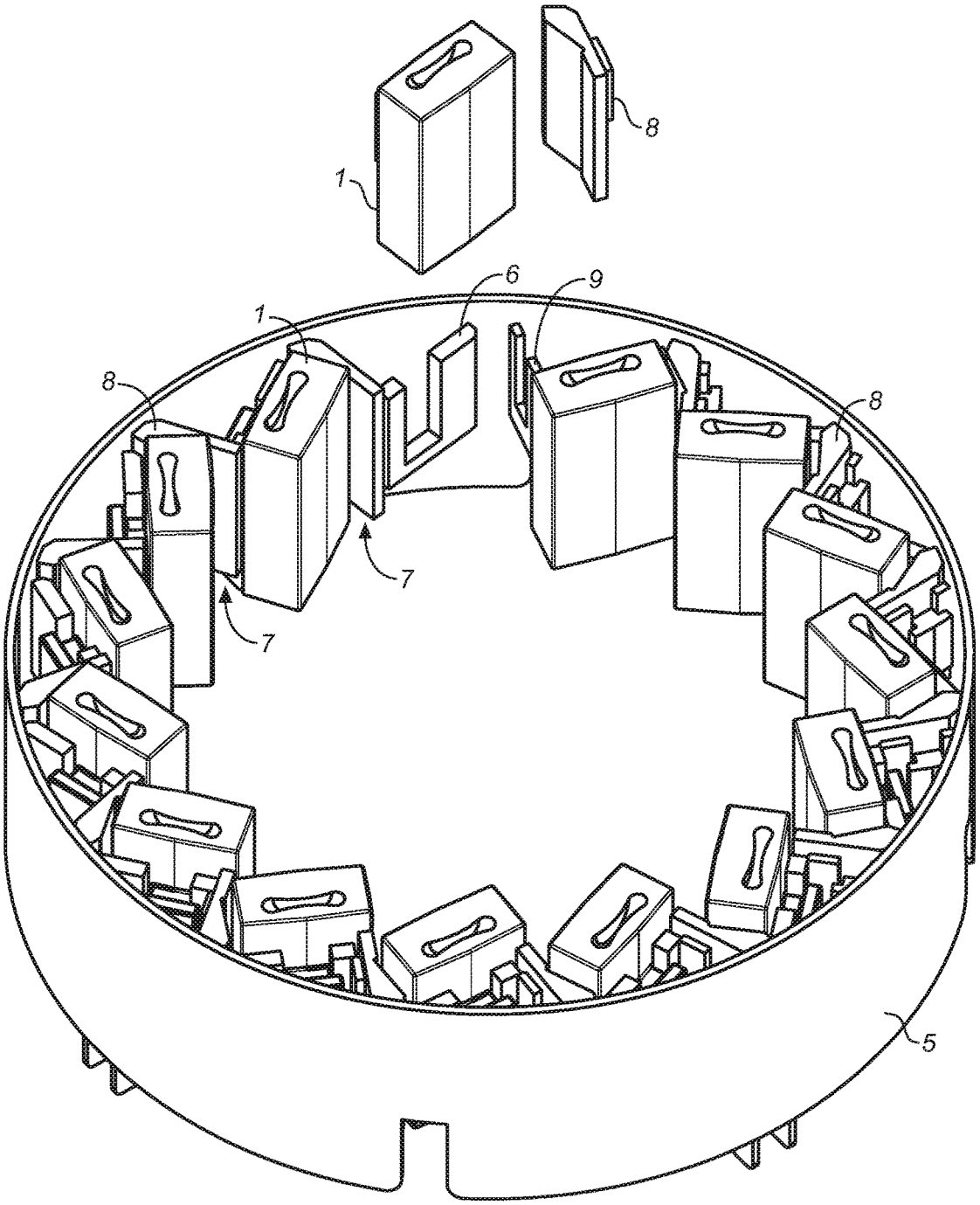
FIG. 1 (PRIOR ART)
FIG. 1 is an upper perspective view of a prior art anvil assembly.
Figure 2A:
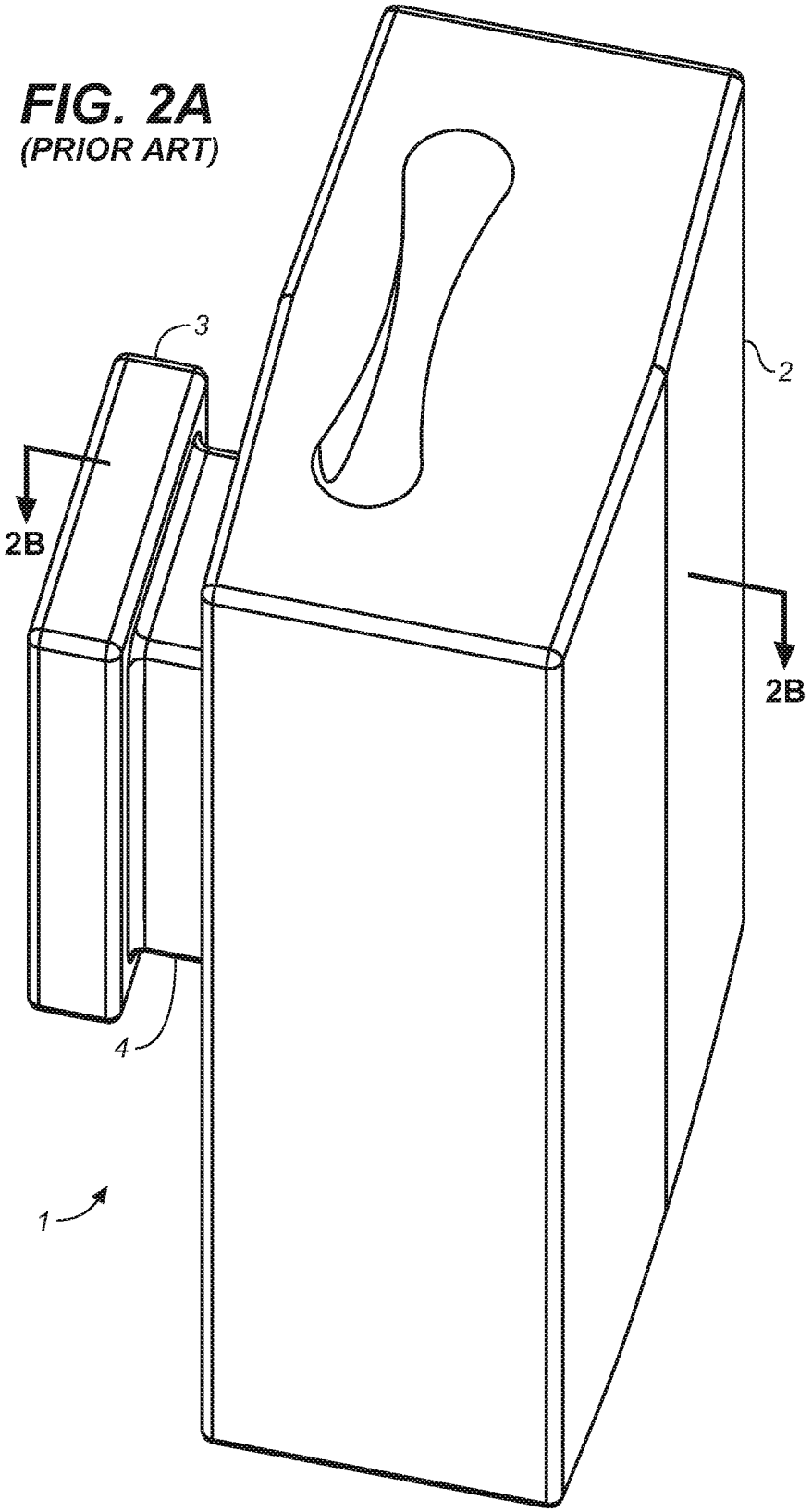
FIG. 2A (PRIOR ART)
FIG. 2A is an upper perspective view of a prior art anvil.
Figure 2B:
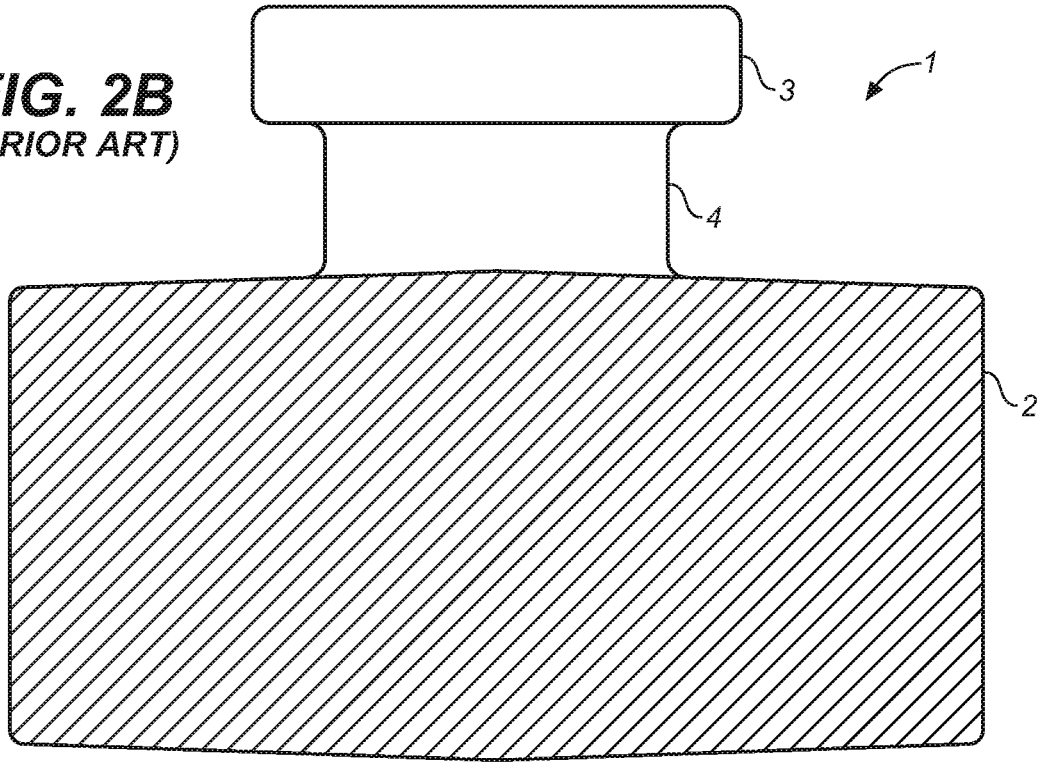
FIG. 2B (PRIOR ART)
FIG. 2B is a sectional view of the prior art anvil taken along line 2B-2B of FIG. 2A.
Figure 2C:
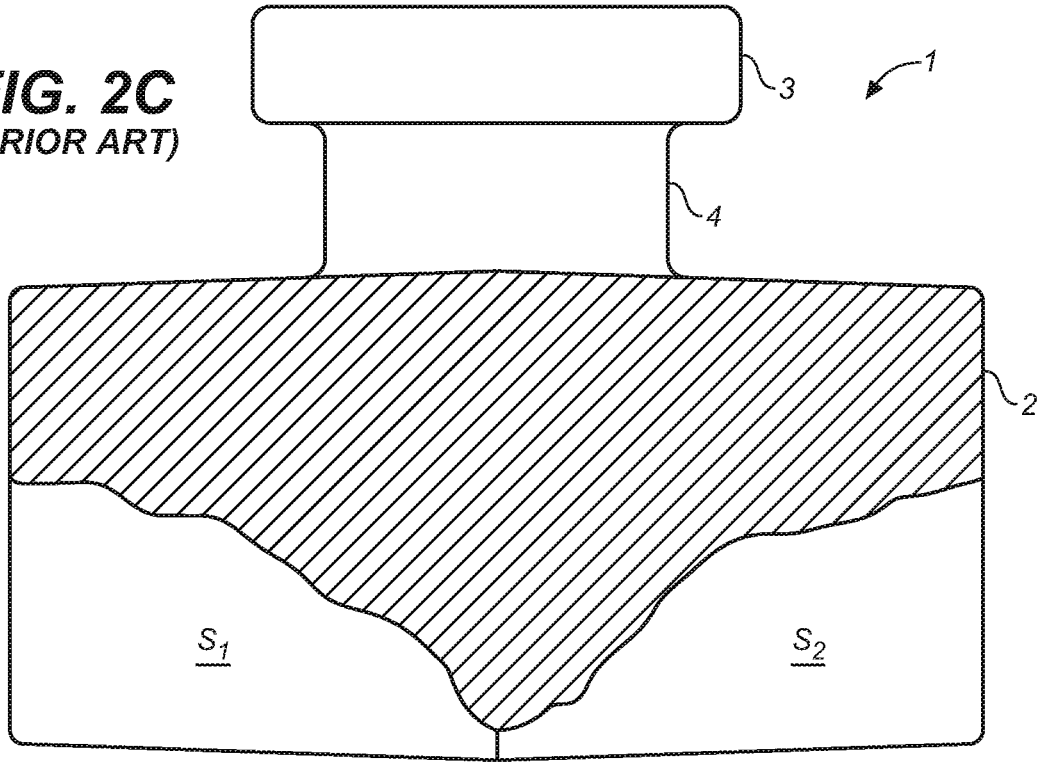
FIG. 2C (PRIOR ART)
FIG. 2C is a sectional view of the prior art anvil of FIG. 2B showing worn areas.
Figure 3:
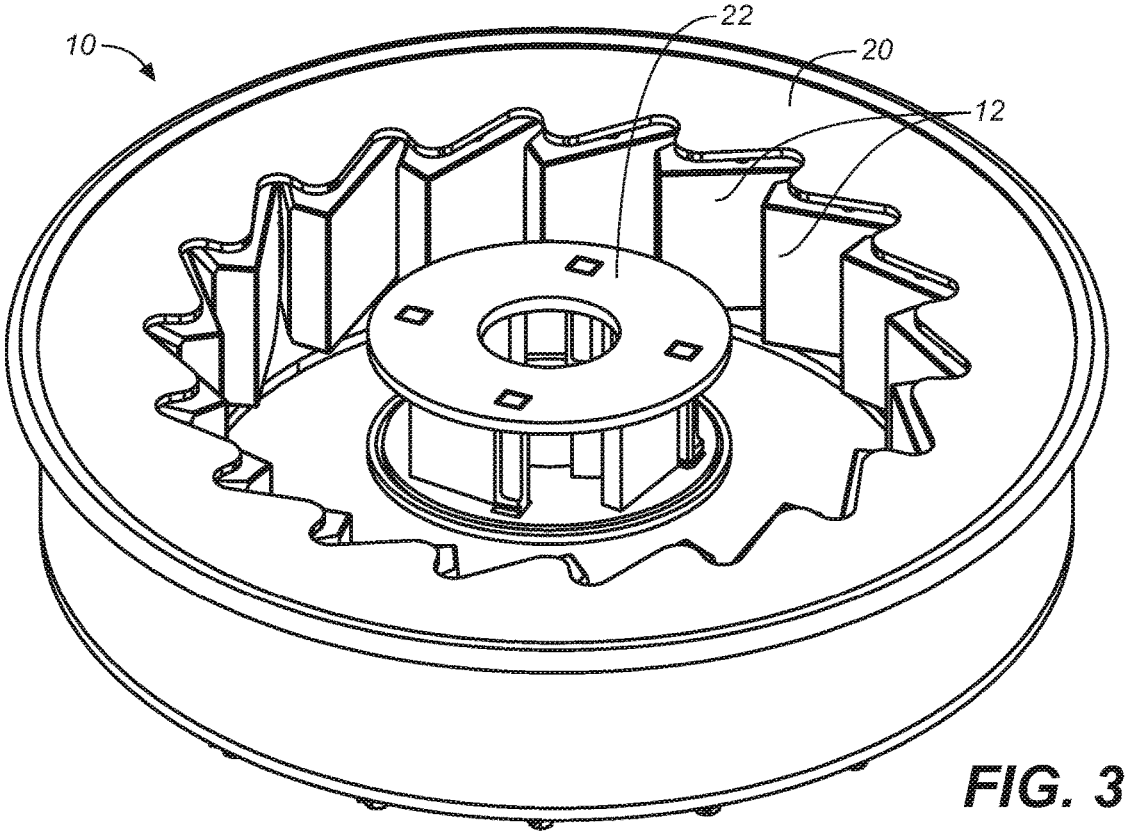
FIG. 3 is an upper perspective view of an anvil assembly for a VSI crusher according to the invention.
Figure 4:
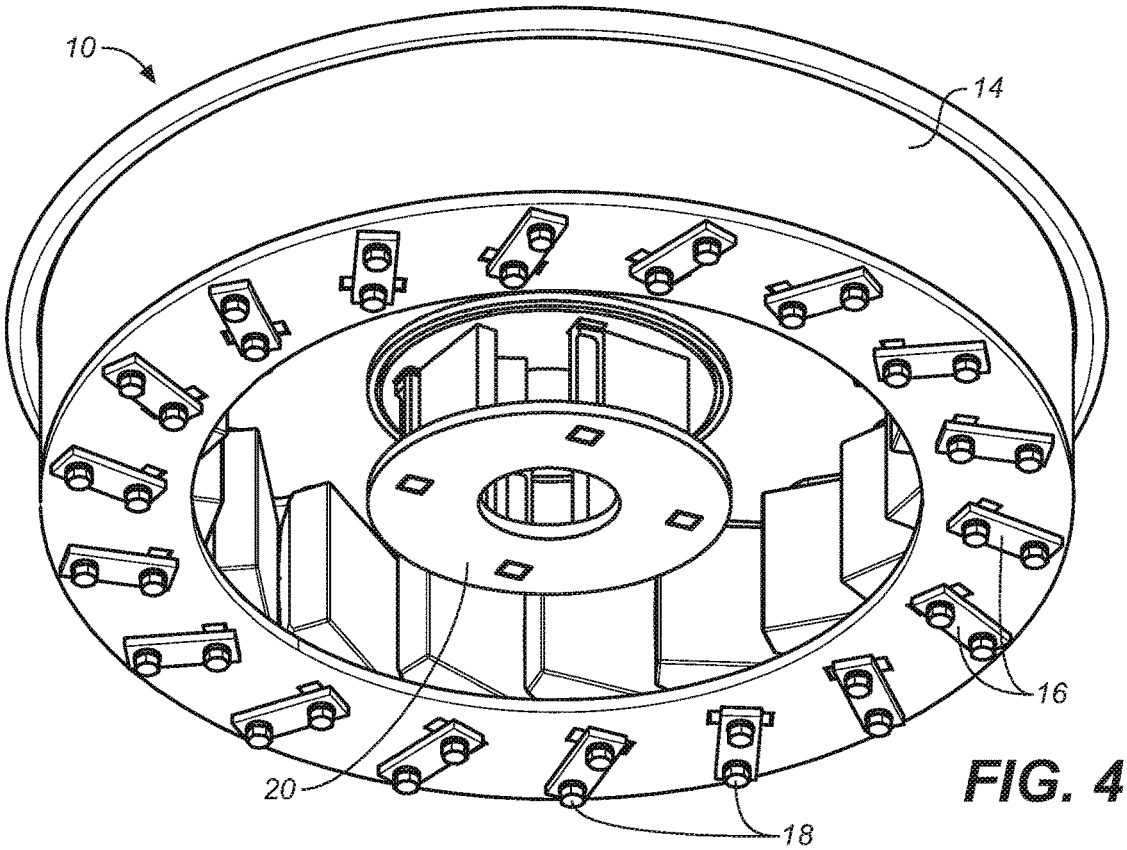
FIG. 4 is a lower perspective thereof.
Figure 5:
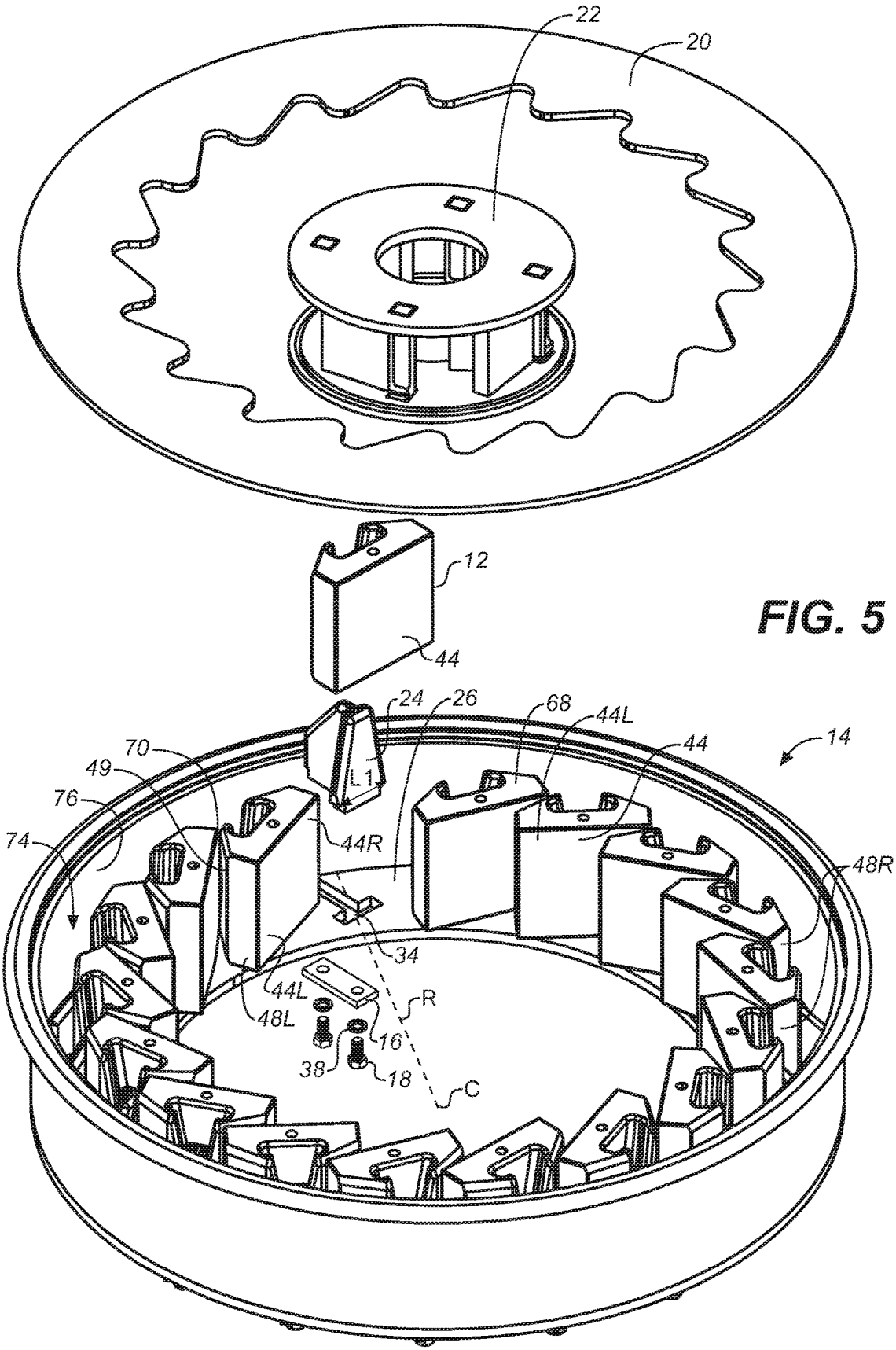
FIG. 5 is an exploded upper perspective view thereof.

An anvil assembly for a VSI crusher is referred to generally at numeral 10 in FIGS. 3 and 4. The anvil assembly comprises a plurality of anvils 12, firmly anchored in an annular arrangement to an anvil ring 14 with retaining plates 16 and fasteners 18. The anvils 12 are covered with an anvil cover plate 20 to minimize collection of dust and dirt on and behind the anvils. A conventional rotor 22 is mounted concentrically relative to the circular assembly of anvils 20 on a vertical shaft (not illustrated). As seen in FIG. 5 each anvil 12 is mounted on an anvil holder 24 which is anchored to the floor 26 of the anvil ring 14.

Figure 6A:
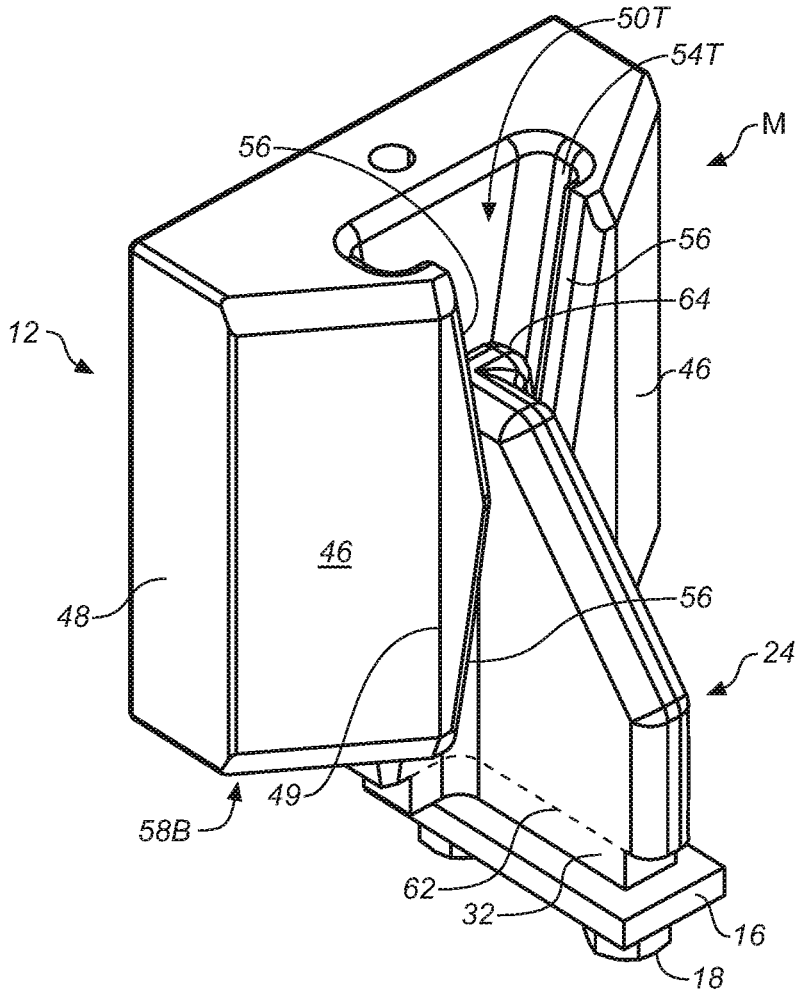
FIG. 6A is an upper perspective view of the anvil, anvil holder, and fastening components thereof, shown assembled.
Figure 6B:
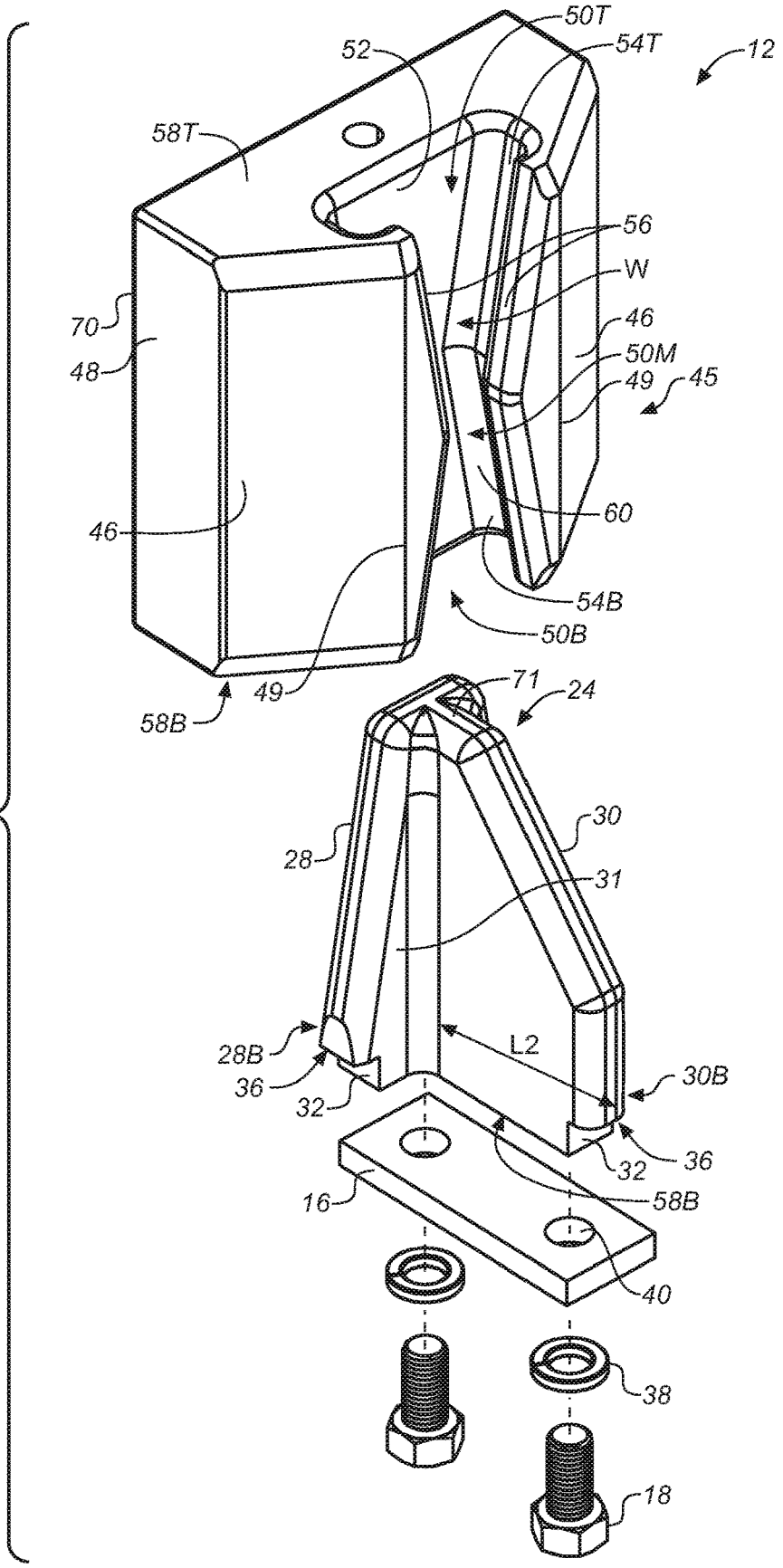
FIG. 6B is an exploded upper perspective view of the anvil, anvil holder, and fastening components shown in FIG. 6A.

With additional reference now to FIG. 6B, it can be seen that the anvil holder 24 comprises a sturdy tapered anchor plate 28 from one side of which a stout buttress wall 30 extends perpendicularly. The anchor plate 28 includes dual oppositely facing tapered shoulders 31 giving the anchor plate 28 a wedge shape. The bottom edges of the anchor plate 28 and buttress wall 30 terminate in a truncated T-shaped foot 32 that is sized to fit in one of a plurality of corresponding T-shaped mounting openings 34 arranged in the floor 26 of the anvil ring 14 shown in FIG. 5. Each of the openings 34 is disposed at an angle relative to a radius line R taken from the center point C of the anvil ring 14, such that when the anvil holder 24 is positioned in the opening 34, the holder 24 is similarly disposed angularly relative to radius line R. The length L1 of the bottom end 28B of the anchor plate 28 is wider than the foot 32 and the length L2 of the bottom end 30B of the buttress wall 30 extends away from the anchor plate 28 farther than the foot 32, such that when the foot 32 is placed in opening 34, the lateral ends of the bottom end 28B of the anchor plate and the distal end 36 of the bottom of the buttress wall 30B form stops that seat the anvil holder 24 in a preset position and angular orientation on the floor 26 of the anvil ring 14.

As seen with reference now to FIGS. 4, 5 and 6B, the anvil holder 24 is anchored to the floor 26 of the anvil ring 14 using a fastener assembly comprising a retainer plate 16, washers 38 and bolts 18. Each retainer plate 16 includes a pair of apertures 40 sized to receive freely bolts 18, which when tightened in threaded bolt holes (not illustrated) in the bottom face 42 of foot 32, firmly secure the anvil holder 24 to the anvil ring 14. Those of skill in the art will appreciate that the invention is not limited to the fastener assembly illustrated.

It can be seen in FIGS. 5 and 6B that each anvil 12 comprises a front face 44, a rear face 45 including two oppositely-disposed, mirror-image, angled, lateral surfaces 46, and side faces 48 extending between front face 44 and lateral surfaces 46. Each lateral surface 46 has an inner edge 49 extending between the top and bottom faces 58T, 58B. Top and bottom docking ports 50T, 50B formed in the rear portion of the anvil include a flat common wall 52 disposed parallel to the front face 44, and top and bottom pairs of opposing, inwardly-oriented side channels 54T, 54B. Each pair of side channels 54T, 54B is separated by a tapered width W from a wider mouth in the top and bottom faces 58T, 58B, respectively, to a narrower gap 60 disposed in a middle portion 50M of the anvil midway between the top and bottom of the anvil 12 where they converge as best seen in FIG. 6B. Tapered guide lips 56 extend inwardly from lateral surfaces 46 following the slope of the side channels 54T, 54B to form a guide surface. In one embodiment of the invention top and bottom docking ports 50T, 50B form vertical mirror-images of each other.

FIG. 6A shows anvil 12 mounted on anvil holder 24 in a mounting configuration M. The side channels 54T, 54B of docking ports 50T, 50B are spaced apart by a tapered width that corresponds to the taper of the shoulders 31 of the anchor plate 28 of anvil holder 24, and the side channels are spaced apart by a width such that when they engage shoulders 31 the bottom face 58B of the anvil 12 is disposed above but in close proximity to the top end 62 of foot 32. Guide lips 56 together form a guide surface for the horizontally extending top edge 71 of buttress wall 30 and wrap around and capture anchor plate 28 when it is disposed in either docking port 50T or 50B. The gap 60 between opposing side channels 54T, 54B is sized so that the upper portion 64 of buttress wall 30 passes freely through it such that when the anchor plate 28 is captured in docking port 50B, as shown, the upper portion 64 thereof extends into top docking port 50T. When anvil 12 is mounted on anvil holder 24 as described, the bottom face 58B or edge of the anvil 12 is positioned closely adjacent to the floor 26 of anvil ring 14. Anvils 12 are comprised of a durable metal, such as cast iron, and are quite heavy. Therefore, the force of gravity alone is sufficient to retain the anvil 12 on anvil holder 24 even when subject to the severe conditions experienced during operation of the crusher.

When a full complement of anvils 12 is assembled in the anvil ring 14, such as is shown in FIG. 5, the left side 44L of the front face 44L of each anvil 12 overlaps and protects the right side 44R of the front face 44 of the left-adjacent anvil. In addition, the right corner 70 is disposed in adjacent alignment with the inner edge 49 of the left lateral surface 46 of the right-adjacent anvil 12 thereby closing off the area 74 behind the ring of anvils 12 from exposure to the stream of particles being ejected from the rotor 22 during operation of the crusher, thereby protecting the side wall 76 of the anvil ring 14 from being damaged.

FIG. 5 shows that, when the anvils 12 are assembled in the anvil ring 14, the left side face 48L and front face 44 together comprise impact faces against which matter ejected from the rotor strikes and is gradually worn away. When the left side face 48L and the left side 44L of the front face 44 of an anvil 12 wear down sufficiently, the anvil 12 easily can be detached from the anvil holder 24, inverted and quickly reinstalled on the anvil holder 24 upside down using the formerly top docking port 50T. This then positions the theretofore protected right side face 48R and the less worn right side 44R of the front face 44 of the anvil 12 to act as the impact faces.

A significant advantage of the anvil assembly disclosed herein is that scrap loss is appreciably reduced. The anvil component of the assembly according to the invention is less expensive to manufacture because docking ports are used instead of the rear-extending mounting stob and neck, thus requiring less material to manufacture each piece. A greater amount of the part is therefore consumed during operation of the crusher, reducing scrap loss. The replacement process is also simplified and shortened because only the one anvil need be replaced instead of replacing two anvils as in the prior art. Additionally, the anvil holder, being detachable from the floor of the anvil ring, can also be replaced as needed.

There have thus been described and illustrated certain embodiments of an anvil assembly for a VSI crusher according to the invention. Although the present invention has been described and illustrated in detail, it should be clearly understood that the disclosure is illustrative only and is not to be taken as limiting.

We claim:

1. An anvil assembly for mounting to a floor of an anvil ring of a vertical shaft impact rock crushing machine, the crushing machine having a rotor rotatably disposed in the anvil ring, the anvil assembly comprising:

a plurality of anvil holders for fastening to a floor of an anvil ring, each of the plurality of anvil holders including an anchor plate, the anchor plate having dual tapered shoulders, a plurality of anvils, each of the plurality of anvils having front, rear, top and bottom faces, the front face forming an impact surface against which matter ejected from a rotor strikes, the rear face including at least one docking port, each of the at least one docking ports having dual, inwardly-oriented, side channels extending from one of the top and bottom faces to a middle portion of the anvil located about halfway between the top and bottom faces, the side channels spaced apart by a tapered width narrower at the middle portion than at the top or bottom face, and a mounted configuration in which the shoulders of each of the plurality of anvil holders are detachably captured in the side channels of the at least one docking port of one of the plurality of anvils, thereby supporting the plurality of anvils on the plurality of anvil holders for securing the plurality of anvils in the anvil ring.

2. The anvil assembly of claim 1 wherein:

the at least one docking port of at least one the anvils comprises two docking ports, one of the docking ports extending from the top face of the at least one of the anvils and the other of the docking ports extending from the bottom face of the at least one of the anvils, the two docking ports of the at least one of the anvils in communication with each other at the middle portion of the at least one of the anvils such that in the mounted configuration a portion of the anvil holder that is captured in the side channels of one of the two docking ports of the at least one of the anvils extends into the other of the two docking ports of the at least one of the anvils.

3. The anvil assembly of claim 2 further comprising:

first and second mounting configurations, in the first mounting configuration the shoulders of the anchor plates of one of the anvil holders are captured in the side channels of one of the docking ports of the at least one of the anvils, and in the second mounting configuration the shoulders are captured in the side channels of the other of the docking ports of the at least one of the anvils, such that the at least one of the anvils is functionally invertible.

4. The anvil assembly of claim 2 wherein:

the two docking ports are vertical mirror images of each other.

5. The anvil assembly of claim 1 wherein:

each of the plurality of anvil holders includes a buttress wall extending perpendicularly from one side of the anchor plate.

6. The anvil assembly of claim 5 wherein:

the floor of the anvil ring further comprises a plurality of T-shaped mounting openings, the anchor plates and the buttress walls of the anvil holders each have a bottom end, and each of the plurality of anvil holders further comprises a T-shaped foot extending from the bottom ends and sized for fitting into one of the plurality of T-shaped mounting openings in the floor of the anvil ring.

7. The anvil assembly of claim 6 wherein:

the anchor plate and the buttress wall each have a bottom end, the bottom end of the anchor plate having an anchor plate length, and the bottom end of the buttress wall having a buttress wall length, and each of the plurality of anvil holders further comprises a T-shaped foot extending downwardly from the bottom ends of the anchor plate and the buttress wall, the T-shaped foot being shorter across the bottom end of the anchor plate than the anchor plate length and shorter across the bottom end of the buttress wall than the buttress wall length, such that the lateral ends of the bottom end of the anchor plate and a distal end of the buttress wall form downwardly facing stops for engaging the floor of the anvil ring when the foot is inserted into one of the plurality of mounting openings.

8. The anvil assembly of claim 5 wherein:

the buttress wall of each of the plurality of anvil holders has a horizontally extending top edge, and the rear face of each of the two docking ports includes dual, opposed, inwardly extending guide lips, each of the guide lips disposed along one of the side channels and forming a guide surface for the top edge of the buttress wall of one of the plurality of anvil holders for assembling the anvil and the anvil holder in the mounted configuration.

9. The anvil assembly of claim 8 wherein:

in the mounted configuration, the guide lips are spaced apart at the middle portion of the anvil a distance slightly greater than the width of the buttress wall, and the buttress wall is interposed between the guide lips.

10. The anvil assembly of claim 1 wherein:

each of the plurality of anvils has dual side faces extending between the front and rear faces and two front corners formed at the intersections of the front face and the dual side faces, and the rear face of each of the plurality of anvils includes dual lateral surfaces, each of the lateral surfaces extending inwardly from one of the side faces at an angle with respect thereto and having an inner edge extending between the top and bottom faces of the anvil, whereby when each of the plurality of anvils is in the mounted configuration, one of the front corners of each anvil is in abutting adjacency with the inner edge of one of the lateral surfaces of the rear face of an adjoining one of the plurality of anvils.

11. The anvil assembly of claim 10 wherein:

the front face of each of the plurality of anvils has left and right sides, and in the mounted configuration, a portion of each of the anvils of the plurality of anvils is disposed radially inward from a portion of the right side of the front face of an adjoining one of the plurality of anvils, thereby protecting the right side from strikes by material ejected from the rotor.

12. The anvil assembly of claim 11 wherein:

in the mounted configuration, the front face and one of the side faces are inwardly oriented and present impact surfaces for material being ejected from the rotor, and a portion of the front face and the other one of the side faces are shielded by an adjoining anvil from material being ejected from the rotor.

13. The anvil assembly of claim 1 wherein:

the at least one docking port further comprises a flat wall extending between the side channels.

14. The anvil assembly of claim 1 further comprising a plurality of bolts and a plurality of retainer plates, each retainer plate having one or more apertures for receiving one of the plurality of bolts, each of the anvil holders having one or more threaded bolt holes, wherein in the mounted configuration, one of the plurality of retainer plates is positioned underneath the floor of the anvil ring, and one of the plurality of bolts is received in one of the apertures of the retainer plate and threadedly engaged with one of the one or more threaded bolt holes of one of the anvil holders for securing the anvil holder to the anvil ring.

15. An anvil assembly for mounting to a floor of an anvil ring of a vertical shaft impact rock crushing machine, the crushing machine having a rotor rotatably disposed in the anvil ring, the anvil assembly comprising:

a plurality of anvil holders for fastening to a floor of an anvil ring, each of the plurality of anvil holders including an anchor plate and a buttress wall, the anchor plate having dual tapered shoulders, the buttress wall extending perpendicularly from one side of the anchor plate, a plurality of anvils, each of the plurality of anvils having front, rear, top and bottom faces, the front face forming an impact surface against which matter ejected from a rotor strikes, the rear face including top and bottom docking ports, each of the docking ports having dual, inwardly-oriented, side channels, the top docking port having side channels extending from the top face to a middle portion of the anvil located about halfway between the top and bottom faces, the bottom docking port having side channels extending from the bottom face to the middle portion, the side channels spaced apart by a tapered width narrower at the middle portion than at the top or bottom face, the docking ports being vertical mirror images of each other, and a first mounting configuration in which the shoulders of the anchor plate of one of the anvil holders are captured in the side channels of one of the docking ports of the anvil, and a second mounting configuration in which said shoulders are captured in the side channels of the other of the docking ports of the anvil.

16. The anvil assembly for mounting to a floor of an anvil ring of a vertical shaft impact rock crushing machine of claim 15, further comprising the floor of the anvil ring further including a plurality of T-shaped mounting openings, the anchor plates and the buttress walls of the anvil holders each having a bottom end, and each of the plurality of anvil holders including a T-shaped foot and dual side faces, said foot extending from the bottom ends and sized for fitting into one of the plurality of T-shaped mounting openings in the floor of the anvil ring, said dual side faces extending between the front and rear faces and two front corners formed at the intersections of the front face and the dual side faces, and the rear face of each of the plurality of anvils includes dual lateral surfaces, each of the lateral surfaces extending inwardly from one of the side faces at an angle with respect thereto and having an inner edge extending between the top and bottom faces of the anvil, whereby when each of the plurality of anvils is in one of the first or second mounted configurations, one of the front corners of each anvil is in abutting adjacency with the inner edge of one of the lateral surfaces of the rear face of an adjoining one of the plurality of anvils.

17. A method for mounting an anvil assembly to a floor of an anvil ring of a vertical shaft impact rock crushing machine, the crushing machine having a rotor rotatably disposed in the anvil ring, the method comprising:

placing a plurality of anchor plates on the floor of the anvil ring, each of said anchor plates having dual tapered shoulders, and mounting a plurality of anvils on the plurality of anchor plates so that the tapered shoulders of each of said plurality of anchor plates are captured in dual, inwardly-oriented side channels in a rear face of at least one docking of one of said plurality of anvils, and in an orientation such that a front face of each of said plurality of anvils is directed toward the rotor thereby presenting an impact surface for rocks ejected therefrom.

18. The method for mounting an anvil assembly to a floor of an anvil ring of a vertical shaft impact rock crushing machine of claim 17, the method further comprising:

fastening the plurality of anchor plates to the floor of the anvil ring.

19. The method for mounting an anvil assembly to a floor of an anvil ring of a vertical shaft impact rock crushing machine of claim 18, the method further comprising:

securing the plurality of anchor plates against forces impacting the front faces of said plurality of anvils.

20. The method for mounting an anvil assembly to a floor of an anvil ring of a vertical shaft impact rock crushing machine of claim 17, the method further comprising:

each of the anvils having two side faces extending between a front face and a rear face, the rear face having two lateral surfaces extending inwardly angularly from one of the two side faces, mounting one of the anvils on one of the anchor plates so that a corner formed by the front face and one of the side faces of the one of the anvils is adjacently aligned with an inner edge of one of the two lateral surfaces of the rear face of an adjoining second one of the anvils.

21. The method for mounting an anvil assembly to a floor of an anvil ring of a vertical shaft impact rock crushing machine of claim 17, the method further comprising:

detaching one of the anvils from one of the anvil plates by removing the tapered shoulders of the one of the anchor plates from one of the docking ports of the one of the anvils, inverting the one of the anvils, and mounting the one of the anvils on the one of the anvil plates such that the tapered shoulders of the one of the anchor plates are captured in a second of the docking ports of the one of the anvils, and in an orientation such that the front face of the one of the anvils is directed toward the rotor thereby presenting an impact surface for rocks ejected therefrom.

* * * * *